US008827095B1

(12) United States Patent
Sackett

(10) Patent No.: US 8,827,095 B1
(45) Date of Patent: Sep. 9, 2014

(54) EXPANDABLE-COLLAPSIBLE SAFE

(71) Applicant: Locker Storage Solutions, LLC, Maple Grove, MN (US)

(72) Inventor: Mark Sackett, Maple Grove, MN (US)

(73) Assignee: Locker Storage Solutions, LLC, Maple Grove, MN (US)

( * ) Notice: Subject to any disclaimer, the term of this patent is extended or adjusted under 35 U.S.C. 154(b) by 0 days.

(21) Appl. No.: 13/949,825

(22) Filed: Jul. 24, 2013

(51) Int. Cl.
*E05G 1/00* (2006.01)
*E05G 1/026* (2006.01)

(52) U.S. Cl.
CPC ..... *E05G 1/005* (2013.01); *E05G 1/026* (2013.01)
USPC ..... 220/4.03

(58) Field of Classification Search
CPC .... B65D 21/086; B65D 21/068; B65D 21/08; B65D 43/20; E05G 1/026
USPC ..... 220/4.03, 8, 812, 811, 254.6, 254.3, 220/254.1, 3.94, 3.8, 3.7; 109/73, 64, 81, 109/80, 78
See application file for complete search history.

(56) References Cited

U.S. PATENT DOCUMENTS 317,920 A * 5/1885 Brown ..... 220/3.7
1,934,138 A * 11/1933 Paul et al. ..... 220/8
2,953,244 A * 9/1960 Curtis ..... 312/205

* cited by examiner

*Primary Examiner* — Robert J Hicks
(74) *Attorney, Agent, or Firm* — Fredrikson & Byron, P.A.

(57) ABSTRACT

An expandable-collapsible safe, comprising a first enclosure, a second enclosure, a door that is movable between an open position and a closed position, an adjustment mechanism adapted to move the first and second enclosures between a collapsed position and an expanded position, and a locking mechanism adapted to lock the door in the closed position.

20 Claims, 20 Drawing Sheets

EXPANDABLE-COLLAPSIBLE SAFE

FIELD OF THE INVENTION

The present invention generally relates to an expandable-collapsible safe. More particularly the present invention relates to an expandable-collapsible safe that could fit inside storage lockers to enhance security.

BACKGROUND OF THE INVENTION

Personal locker facilities have been commonly found in public places, educational institutions, hospitals, schools, health clubs, military facilities and similar establishments. Personal lockers are available in these places for safekeeping of personal items. These personal lockers often come in a variety of different sizes and shapes.

Personal lockers are typically secured by using locks such as padlocks or hatch locks, coin-deposit locks, combination locks wherein a user dials a numeric sequence to unlock the locker facility, or a keyless lock wherein a numeric sequence is entered using a keypad to open the locker. Some of the locker facilities are prone to theft of contents stored in the lockers because of the relative ease with which common lock mechanisms can be broken into. Additionally, personal lockers are sometimes shared between two or more users, as is often the case at schools, resulting in lack of privacy and possibility of theft. Safekeeping personal items are also of concern in other storage areas such as a trunk or glove compartment of a vehicle.

It would be desirable to provide a safe that can fit inside any sized and shaped personal locker or storage area to enhance the security of contents therein.

SUMMARY

Certain embodiments of the present invention are described in the following numbered illustrative embodiments. An expandable-collapsible safe is provided. In certain embodiments, the expandable-collapsible safe includes a first enclosure, a second enclosure, a door, an adjustment mechanism and a locking mechanism. The second enclosure can be modularly engaging with the first enclosure to create a storage space therein.

The door can be on either the first enclosure or the second enclosure and be movable between an open position and a closed position. The door can also be coupled to the first enclosure or the second enclosure by a door connector. In some cases, the door connector includes a hinge connection such that the door rotates about the hinge connection. The door can also be configured to cover an opening on the first and second enclosures.

The adjustment mechanism can be peripherally located on the first and second enclosures and is adapted to move the first and second enclosures between a collapsed position and an expanded position. In some cases, the adjustment mechanism can be adapted to move the first and second enclosures between a collapsed position and an expanded position by sliding movement of the first enclosure and the second enclosure. In certain cases, a pushing force is applied to the first and second enclosures to collapse the expandable-collapsible safe and a pulling force is applied to the first and second enclosures to expand the expandable-collapsible safe.

The adjustment mechanism can include a first tension bar operably coupled to the first enclosure and a second tension bar operably coupled to the second enclosure, wherein the first tension bar engages with the second tension bar to expand and collapse the expandable-collapsible safe. The first tension bar and the second tension bar can be adapted to move the first enclosure and the second enclosure towards each other to collapse the expandable-collapsible safe when a pushing force is applied to the first tension bar and the second tension bar or away from each other to expand the expandable-collapsible safe when a pulling force is applied to the first tension bar and the second tension bar. In some cases, one of the first tension bar and the second tension bars operably engages with the locking mechanism to lock the expandable-collapsible safe in a locked position.

The locking mechanism can be adapted to lock the door in the closed position. In some cases, locking mechanism includes a locking bar and a hasp located on the door. The locking bar can engage with the hasp in a closed position and disengage with the hasp in the open position. In some cases, the hasp can be positioned on the door.

In some cases, the adjustment mechanism comprises a tension bar with a slot and the locking mechanism comprises a locking bar. The locking bar can engage with the slot of the tension bar in a sliding engagement. The locking bar can also include a first end having a flared portion, wherein the flared portion has a width larger than the slot of the tension bar. The locking bar can also engage with the tension bar and the hasp to maintain the door in the closed position and disengage with the tension bar and the hasp to move the door from the closed position to the open position.

In yet other cases, the adjustment mechanism can include a first tension bar and a second tension bar. The first tension bar can include a plurality of recesses and the second tension bar can include a pin and the recesses can be configured to receive the pin. The pin can be removed from a first recess of the plurality of the recesses when the expandable-collapsible safe is expanded or collapsed. Likewise, the pin can be placed in a second recess of the plurality of the recesses after the expandable-collapsible safe is expanded or collapsed. Also, the second tension bar can be pivotably connected to a bracket and the bracket can be operably coupled to the pin of the second tension bar such that when a pushing force or a pulling force is applied on the first and second enclosures, the bracket is adapted to move the pin from the first recess of the plurality of recesses to the second recess of the plurality of recesses.

In other cases, the first tension bar can be coupled to the first enclosure by a first hinge connector and the second tension bar can be coupled to the second enclosure by a second hinge connector. Also, the first tension bar can rotate in a first direction about the first hinge connector and the second tension bar can rotate in a second direction about the second hinge connector, wherein the expandable-collapsible safe is adapted to move between the expanded position and the collapsed position by applying the pushing force to collapse or the pulling force to expand the expandable-collapsible safe. Further, the first tension bar can rotate in a third direction about the first hinge connector and the second tension bar can rotate in a fourth direction about the second hinge connector, after the pushing force or the pulling force is removed. Still further, the door can rotate about a rotational axis between the open position and the closed position, the rotational axis of the door being perpendicular to the first and second hinge connectors.

The expandable-collapsible safe can also include at least one bumper located on the peripheral portion of the expandable-collapsible safe, the bumper forming a frictional fit between the expandable-collapsible safe and an enclosure.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1:
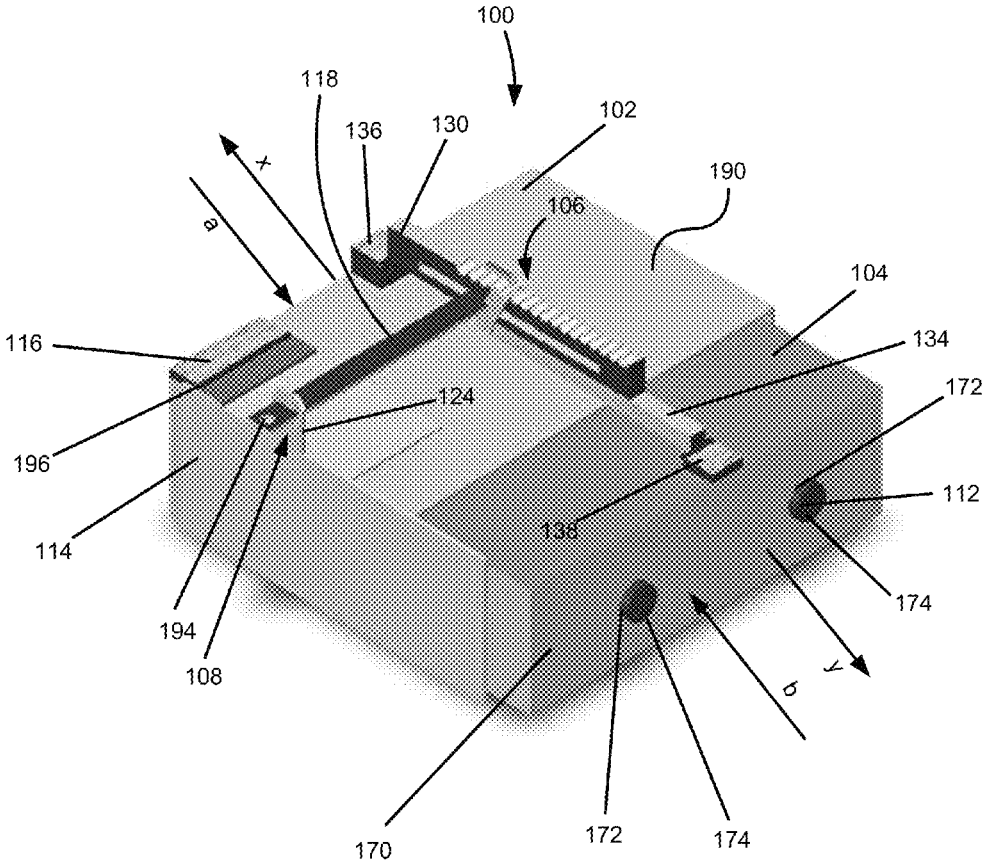
FIG. 1 is a perspective view of an expandable-collapsible safe according to some embodiments of the invention.

FIG. 1 shows a perspective view of an expandable-collapsible safe 100 according to one embodiment. In the illustrated embodiment, the expandable-collapsible safe 100 includes a first enclosure 102, a second enclosure 104, an adjustment mechanism 106 and a locking mechanism 108. The first enclosure 102 is sized and positioned to operably receive the second enclosure 104. The adjustment mechanism 106 is positioned peripherally on the first and second enclosures to adjust the size of the safe. The adjustment mechanism 106 can be engaged so that moving the second enclosure 104 further inside the first enclosure 102 collapses the safe, and moving the second enclosure 104 away from the first enclosure 102 expands the safe. The size of the safe 100 can be adjusted to fit inside lockers or storage spaces of various sizes.

The first and second enclosures 102, 104 are illustrated as having a rectangular cross-section in FIG. 1. However, the enclosures 102, 104 can be provided as other shapes if desired, such as a square cross-section. The shape of the enclosures 102, 104 is typically determined by the shape of the locker or storage space inside which the safe will be placed. Many personal lockers in public facilities, educational institutions, hospitals, health clubs and military facilities are shaped so that they have a rectangular or square cross-section. However, the shape of the expandable-collapsible safe 100 can easily be modified to fit inside irregularly shaped storage areas, such as glove compartments in vehicles. The first and second enclosures 102, 104 are sized so that the first enclosure 102 operably receives the second enclosure 104.

Figure 2:
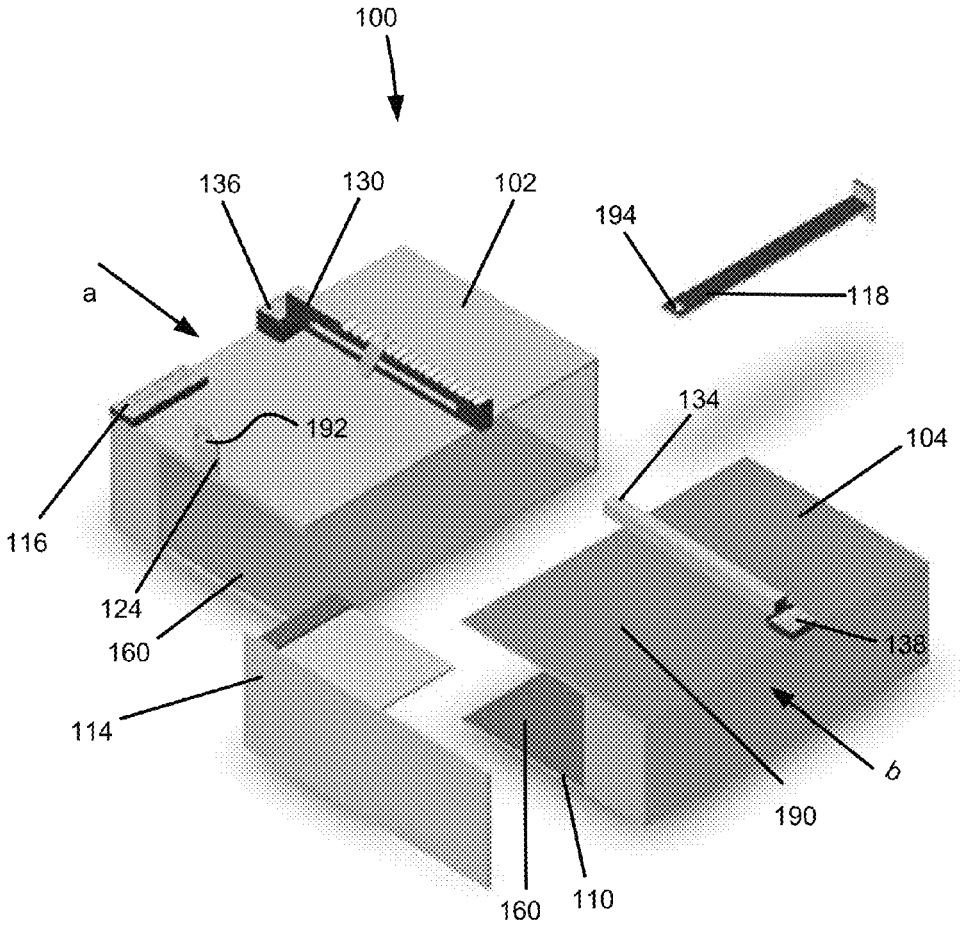
FIG. 2 is an exploded perspective view of the expandable-collapsible safe shown in FIG. 1.

FIG. 2 is an exploded perspective view of the expandable-collapsible safe 100. The expandable-collapsible safe 100 can be expanded or collapsed by applying a pulling or pushing force equally on both the first and second enclosures 102, 104. As shown in FIG. 1, when a pulling force is applied on the first enclosure 102 along direction "x", and on the second enclosure 104 along direction "y", the safe 100 expands and the size increases. As shown in FIG. 2, when a pushing force is applied on the first enclosure 102 along direction "a", and on the second enclosure 104 along direction "b", the safe 100 collapses and the size decreases.

One of the lateral faces 110 of the enclosures 102, 104 includes an opening 160 to provide access to the interior of the enclosures 102, 104. The opening 160 can have a variety of different sizes and shapes. For example, smaller-sized contents such as mobile phones, tablet devices, keys and the like can be accommodated easily inside the expandable-collapsible safe 100 if the opening 160 on the lateral face 110 is on the order of few inches, typically 6 to 10 inches. On the other hand, the expandable-collapsible safe 100 can be expanded and adjusted to fit inside lockers of much larger sizes. In such embodiments, the size of the opening 160 on the lateral face 110 is increased correspondingly.

Figure 3:
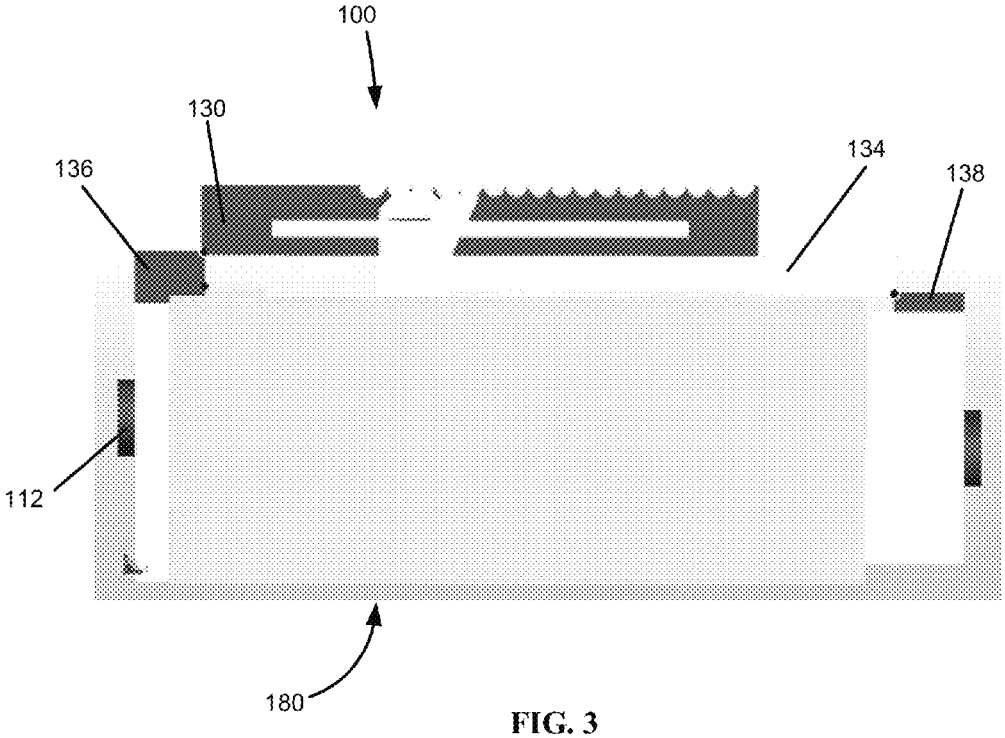
FIG. 3 is a view from the front of the expandable-collapsible safe shown in FIG. 1.
Figure 4:
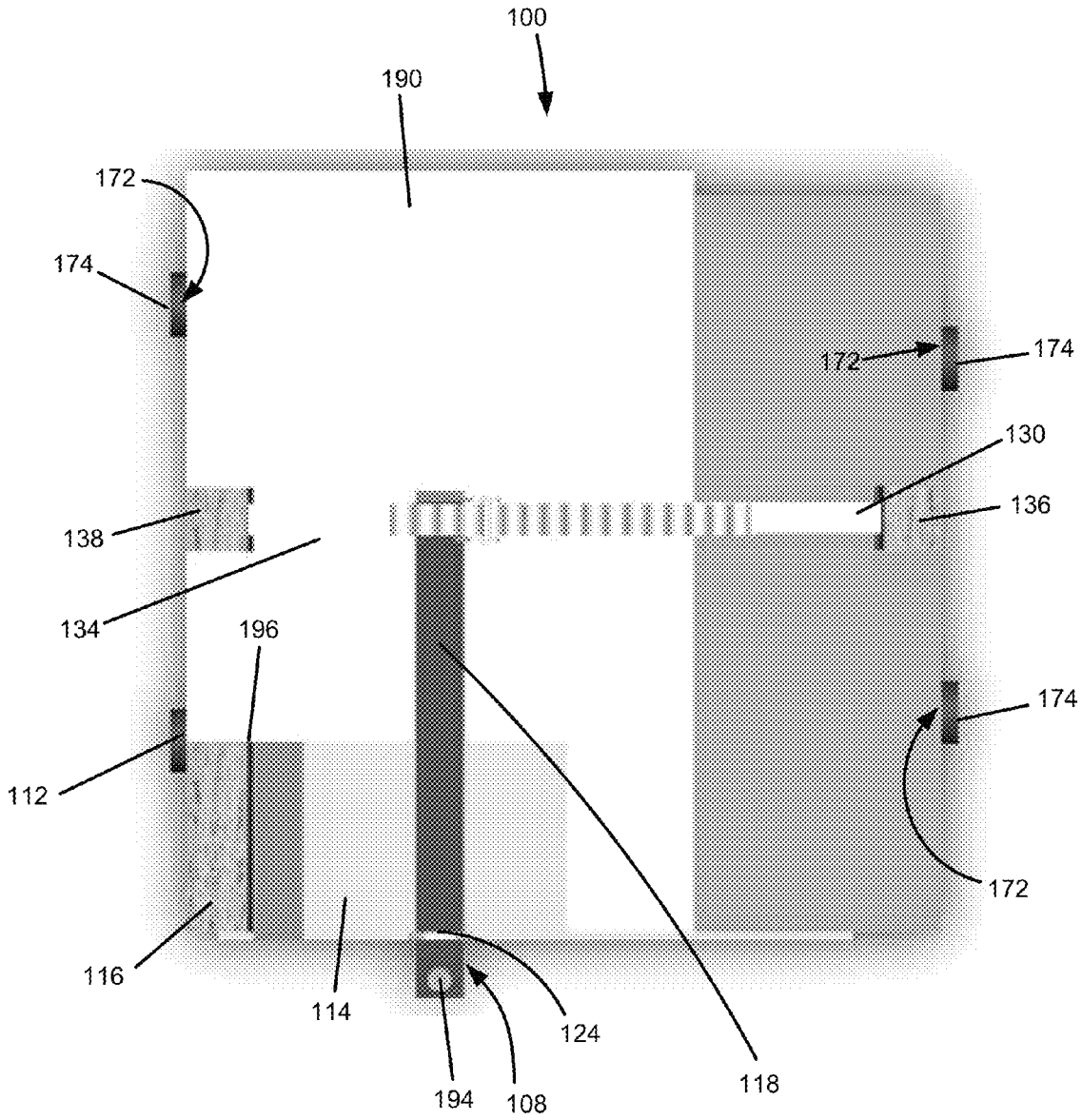
FIG. 4 is a view from the top of the expandable-collapsible safe shown in FIG. 1.
Figure 5:
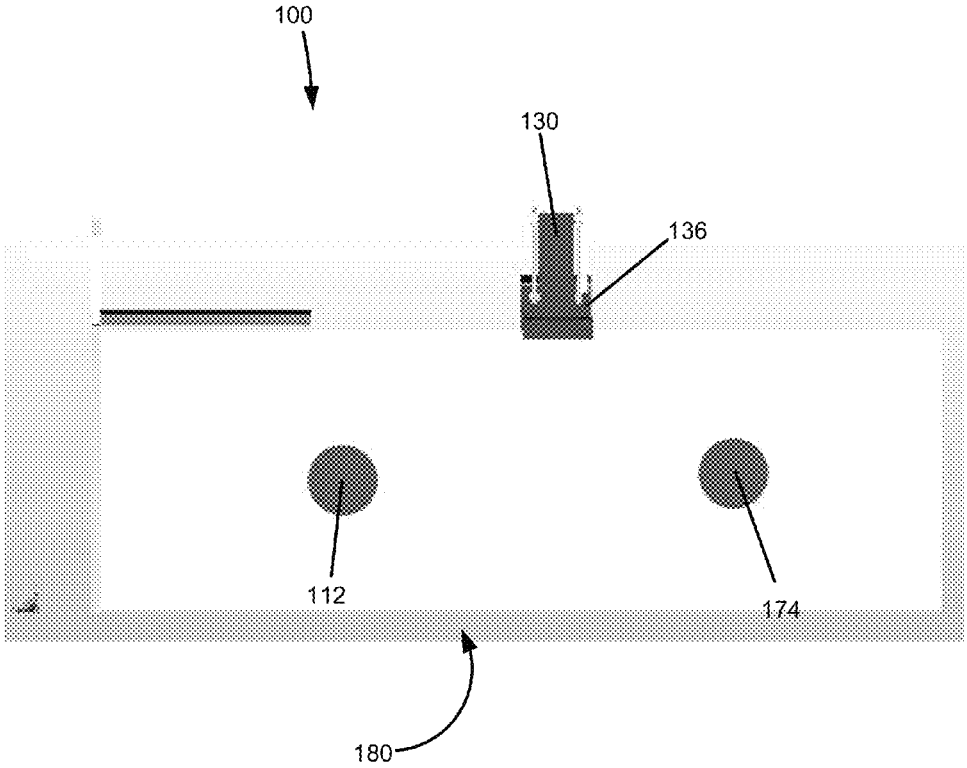
FIG. 5 is a view from the left of the expandable-collapsible safe shown in FIG. 1.

The expandable-collapsible safe 100 can also include a plurality of bumpers 112 as seen in FIGS. 3 and 4. The bumpers 112 can have any desired shape. In the illustrated embodiment, they are illustrated as having cylindrical shape. The illustrated embodiment the expandable-collapsible safe 100 includes four bumpers located peripherally. Any number of bumpers 112 can be included. The bumpers 112 have a proximal face 172 and a distal face 174, the proximal face 172 being the face facing the safe 100 and the distal face 174 being the face facing away from the safe 100. The bumpers 112 are placed peripherally on the first and second enclosures 102 and 104 by coupling the proximal face 172 of the bumpers 112 to the enclosures using any coupling mechanism known in the arts, such as adhesives.

When the expandable-collapsible safe 100 is placed inside a locker or storage space, the distal face 174 of the bumpers 112 provide a friction fit against the lateral walls of a locker. The friction fit helps prevent the expandable-collapsible safe 100 from easily being removed from the storage space. An exact fit between the lateral walls of the storage space and the expandable-collapsible safe 100 is desirable for enhanced security. In other embodiments, additional or alternative bumpers 112 can be located at a bottom wall 180 of the safe 100 or at any other peripheral location which would ensure a frictional fit between the expandable-collapsible safe 100 and a locker, a glove compartment of vehicle or other storage space.

As perhaps best shown in FIG. 4, a locking mechanism 108 facilitates locking the first and second enclosures 102, 104. The locking mechanism 108 includes a door 114, a door connector 116, a locking bar 118 and a hasp 124. The door 114 is of a length and width to completely cover the opening 160 on the lateral face 110 of the enclosures. The door connector 116 operably couples the door 114 to one of the enclosures. The door connector 116 can be fabricated by molding or casting together with one of the enclosures. The door connector 116 includes mechanisms known in the arts such as a hinge joint to operably couple the door 114 to one of the enclosures. In some embodiments of the invention, the door 114 is pivoted about the door connector 116, and is able to rotate about the door connector as shown in FIG. 6.

Figure 8:
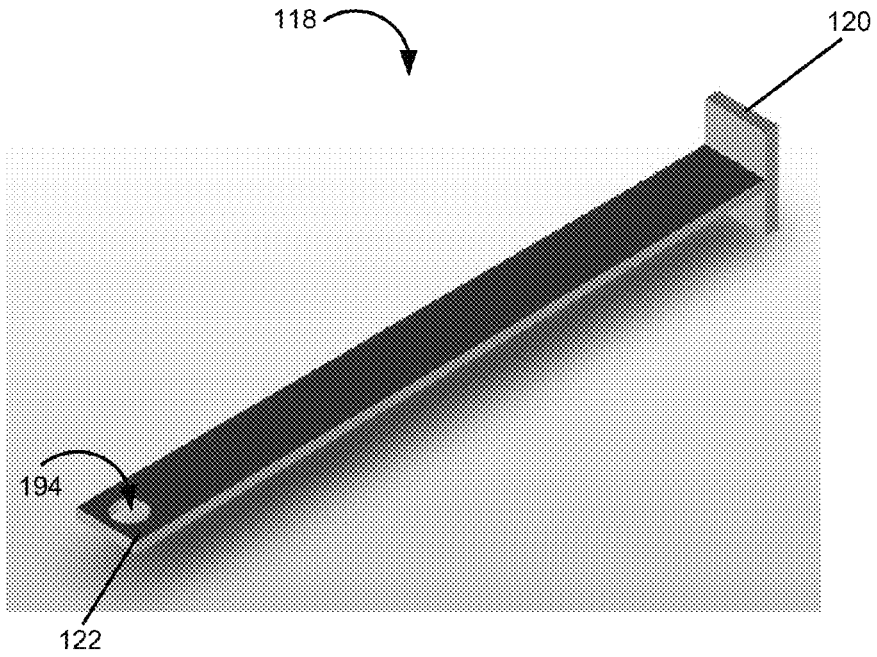
FIG. 8 is a perspective view of a locking bar of an expandable-collapsible safe shown in FIG. 1 according to some embodiments.

As perhaps best shown in FIG. 8, the locking bar 118 comprises a first end 120 and a second end 122. The first end 120 of the locking bar 118 operably engages with the adjustment mechanism 106. The second end 122 of the locking bar operably engages with the hasp 124. In certain embodiments, the locking bar 118 has a thickness smaller than the thickness of a slot 192 located on the hasp 124 to operably engage with the slot 192. The second end 122 of the locking bar 118 includes an opening 194. A lock (not shown) can be coupled to the opening 194 on second end 122 of the locking bar 118 to lock the door 114 and secure the contents of the expandable-collapsible safe 100. Many commonly available locks such as padlock, cable lock, combination lock or other means known in the art can then be used to lock the expandable-collapsible safe 100.

Figure 7:
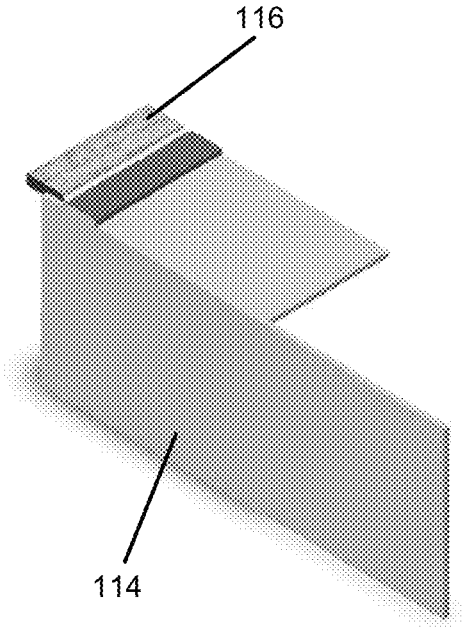
FIG. 7 is a perspective view of a door of an expandable-collapsible safe shown in FIG. 1.

The door connector 116 is located on a top surface 190 of the first enclosure 102. The door connector 116 pivotally couples with the door 114 as shown in FIG. 7. A hinge connection facilitates pivotal coupling of the door connector 116 with the door 114 and allows the door 114 to rotate about the hinge 196. The door connector 116 can instead be coupled to the door using other coupling means known in the art, such as a bracket connector instead of a hinge connection. It can also be appreciated that the door connector 116 can easily be positioned on other surfaces, such as the bottom or lateral surfaces of the first enclosure 102. Likewise, the door connector 116 and the door 114 can instead be attached to the second enclosure 104.

Figure 6:
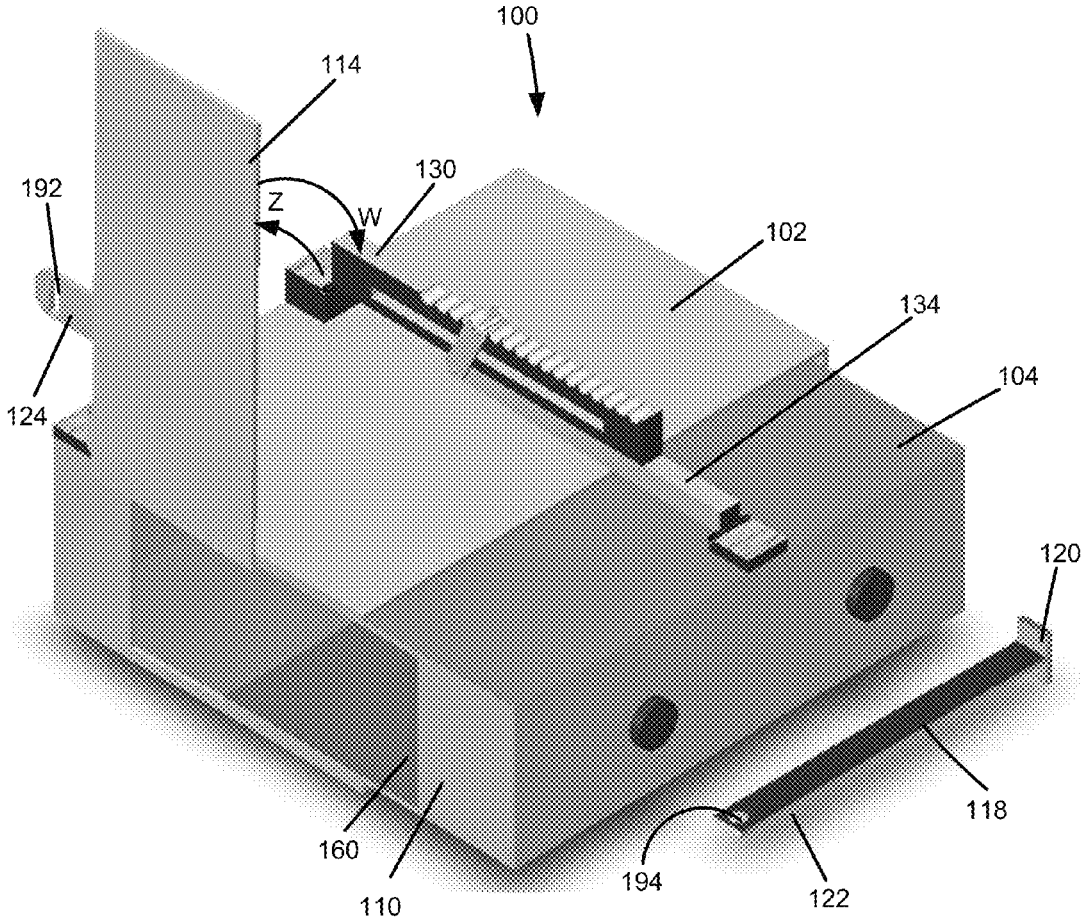
FIG. 6 is a perspective view of the expandable-collapsible safe shown in FIG. 1 with the door in an open position.

FIG. 6 shows the expandable-collapsible safe 100 with the door 114 in an open position.

In this open position, the locking bar 118 does not engage with the hasp 124. The expandable-collapsible safe 100 can be locked by rotating the door 114 about the door connector 116 in a direction "w". The door 114 rotates from the open position to a closed position. The first and second ends 120 and 122 of the locking bar, perhaps best shown in FIG. 8, are then engaged with the adjustment mechanism 106 and the hasp 124. A lock can then be connected with the opening 194 on the second end 122 of the locking bar 118 to lock the expandable-collapsible safe 100 and secure its contents.

When a user wishes to unlock the expandable-collapsible safe 100, the user first disengages the lock from the opening 194 on the second end 122 of the locking bar 118. The user then disengages the locking bar 118 from the hasp 124 and the adjustment mechanism 106. Once the locking bar 118 is disengaged, the user rotates the door 114 in a direction "z", providing access to the contents stored in the expandable-collapsible safe 100.

Figure 19:
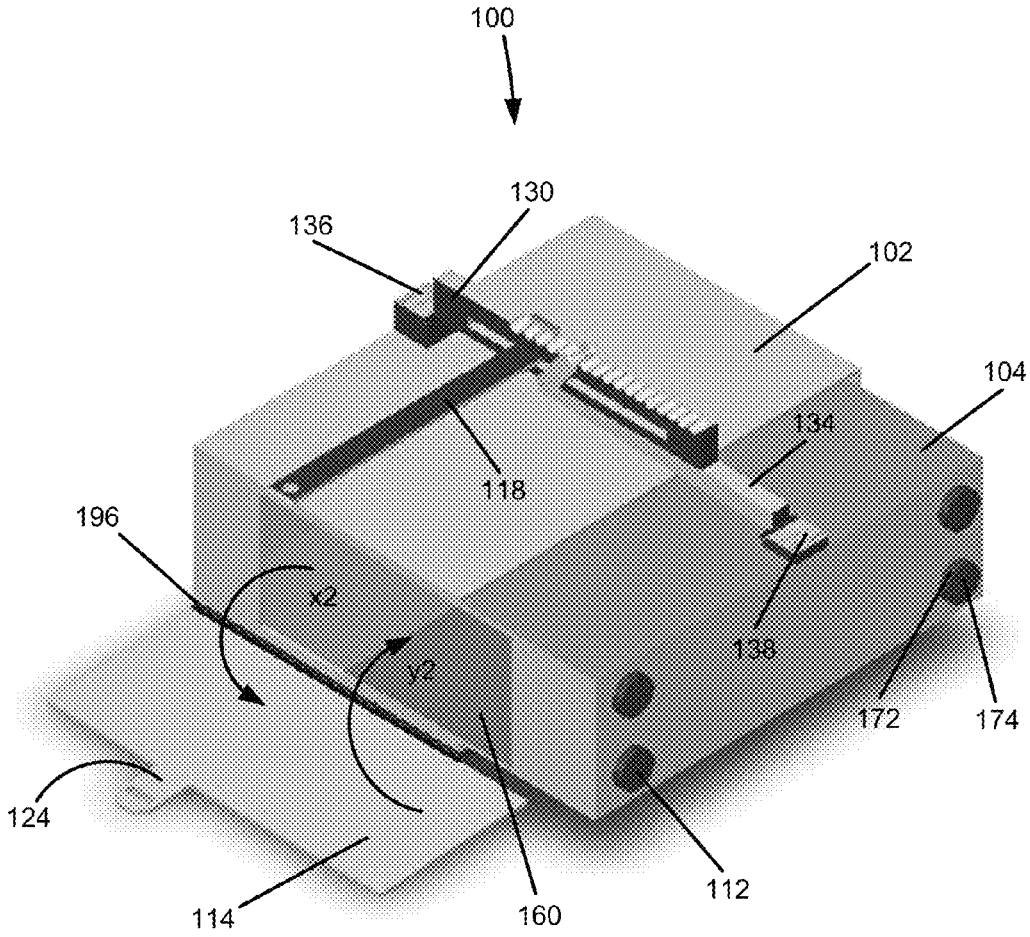
FIG. 19 is a perspective view of the expandable-collapsible safe of FIG. 17 with the door in an open position.
Figure 20:
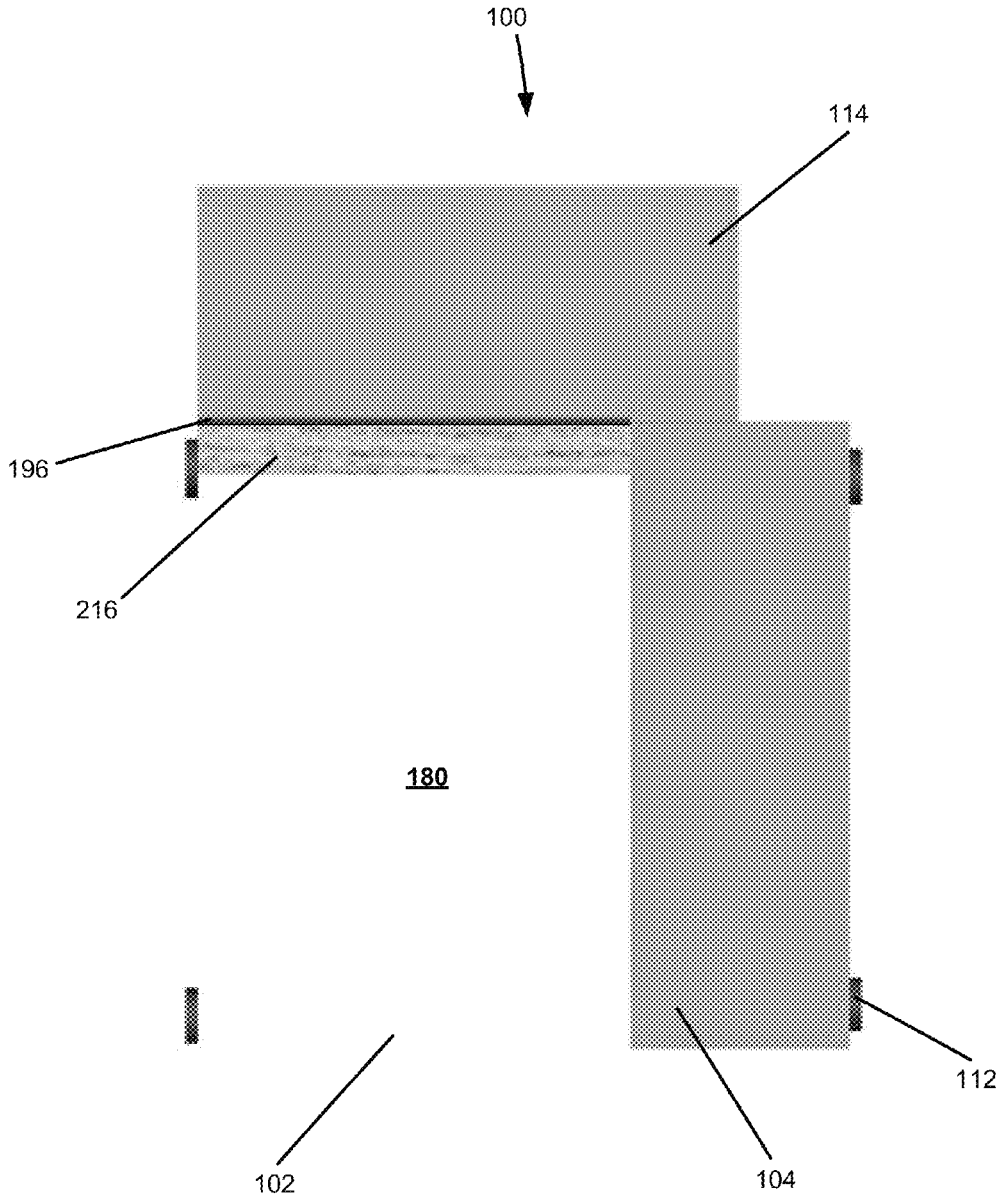
FIG. 20 is a bottom view of the expandable-collapsible safe of FIG. 18.

As illustrated in FIGS. 17-20, in an alternate embodiment, the door connector 216 can be positioned on the bottom surface 180 of the second enclosure 104. The door connector 216 can be fabricated by molding or casting together with one of the enclosures. The door connector 216 comprises mechanisms known in the arts such as a hinge joint to operably couple the door to one of the enclosures. In some embodiments of the invention, the door 114 is pivoted about the door connector 216, and is able to rotate about the door connector as shown in FIG. 19. A hinge connection facilitates pivotal coupling of the door connector 216 with the door 114 and allows the door 114 to rotate about the hinge 196. It can be appreciated that the door connector 216 can easily be positioned on other surfaces, such as the lateral surfaces of the enclosure. Additionally, the door connector 216 and the door 114 can be coupled to at least one of the first and second enclosures 102 and 104 by other means known in the arts, such as by using a bracket connector instead of a hinge connection.

FIG. 19 shows the expandable-collapsible safe with the door 114 in a fully open position. In this position, the locking bar 118 does not engage with the hasp 124. The expandable-collapsible safe can be locked by rotating the door 114 about the door connector 216 in a direction "y2". The door rotates from the fully open position to a fully closed position. The first and second ends 120 and 122 of the locking bar (FIG. 8) are then engaged with the adjustment mechanism 106 and the hasp 124. A lock is then connected with the opening on the second end 122 of the locking bar 118 to lock the expandable-collapsible safe and secure its contents.

In the illustrated embodiment shown in FIGS. 17-20, when a user wishes to unlock the expandable-collapsible safe 100, the user first disengages the lock from the opening on the second end 122 of the locking bar 118 by means known in the arts, such as using a compatible key with the lock, by entering a numerical combination on the combination lock dial, or by other means known in the arts. The locking bar 118 is disengaged from the hasp 124 and the adjustment mechanism 106. Once the locking bar 118 is disengaged, the door 114 can be rotated in a direction "x2", providing access to the contents stored in the expandable-collapsible safe 100.

Figure 12:
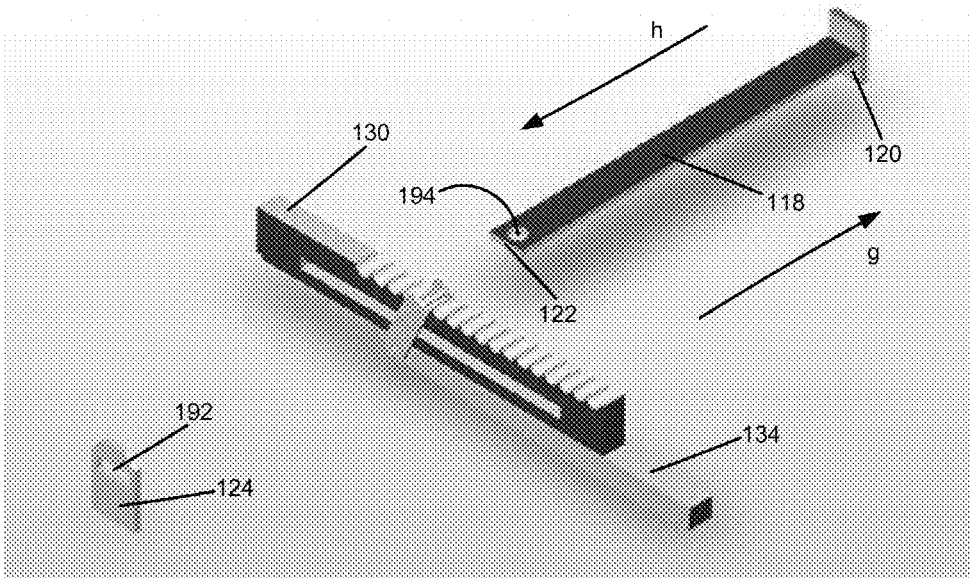
FIG. 12 is an exploded perspective view from the adjustment mechanism shown in FIG. 11.
Figure 13:
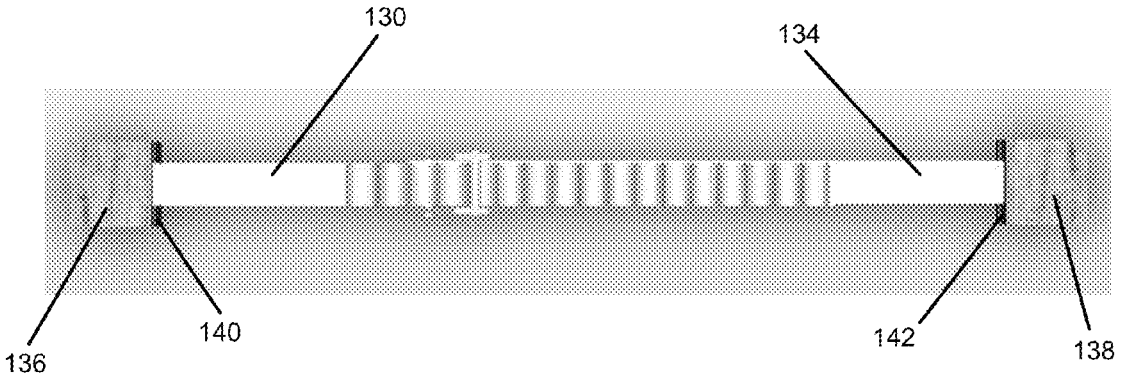
FIG. 13 is a view from the top of the adjustment mechanism shown in FIG. 11.

The expandable-collapsible safe 100 includes an adjustment mechanism 106 as shown in FIG. 1. The adjustment mechanism 106 is illustrated in detail in FIGS. 11-16. The adjustment mechanism 106 includes a first tension bar 130 and a second tension bar 134. The first and second tension bars 130, 134 are coupled to the first and second enclosures 102, 104 by first and second connectors, 136, 138 respectively. The first and second enclosures 102, 104 can be fabricated by techniques such as molding or casting to include the first and second connectors 136, 138 on the periphery of the first and second enclosures 102, 104. FIG. 13 shows the adjustment mechanism 106 as viewed from the top.

Figure 14:
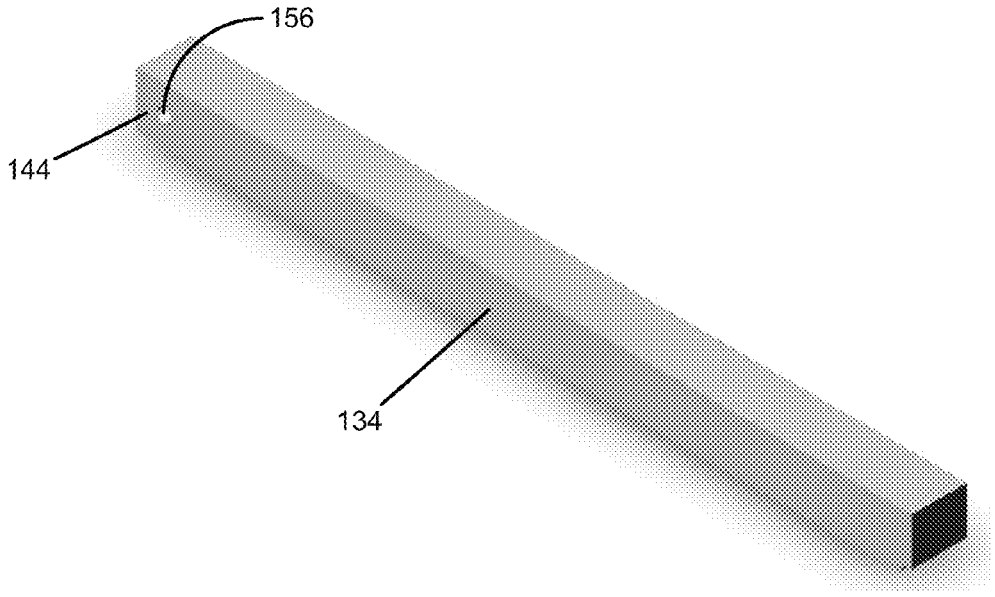
FIG. 14 is a perspective view of a second tension bar of the adjustment mechanism shown in FIG. 11 according to some embodiments.
Figure 15:
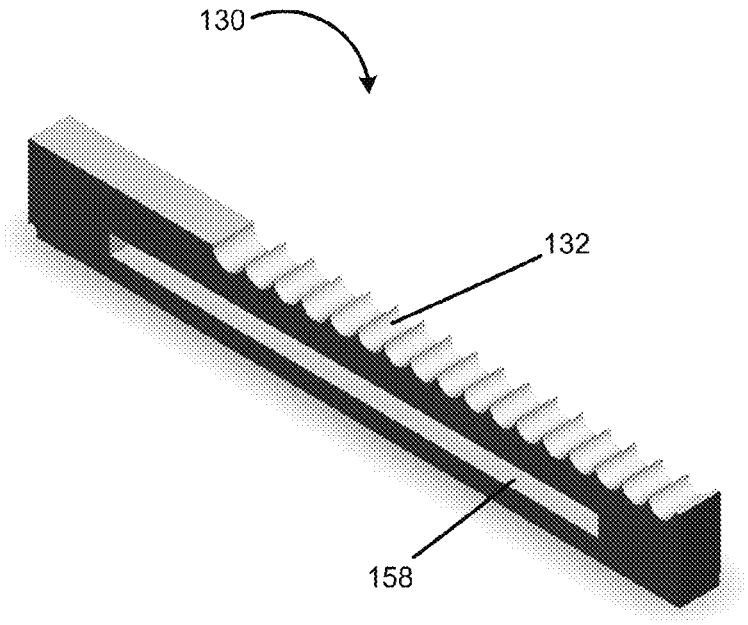
FIG. 15 is a perspective view of a first tension bar of the adjustment mechanism shown in FIG. 11 according to some embodiments.
Figure 16:
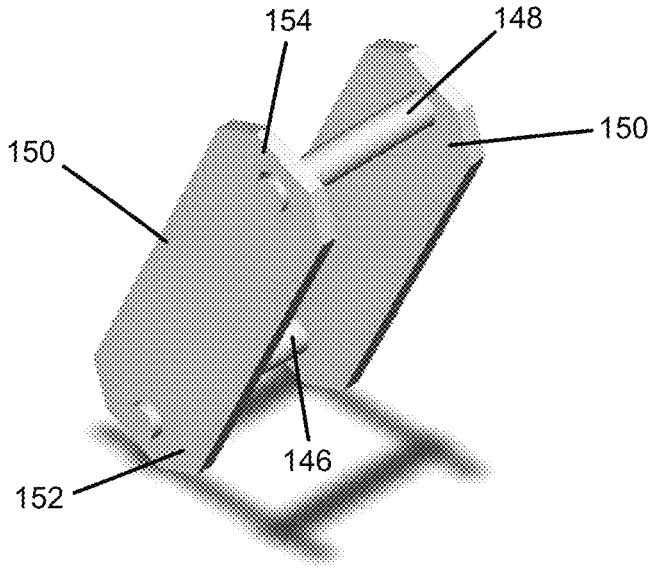
FIG. 16 is a perspective view of a bracket of the adjustment mechanism shown in FIG. 11 according to some embodiments.
Figure 17:
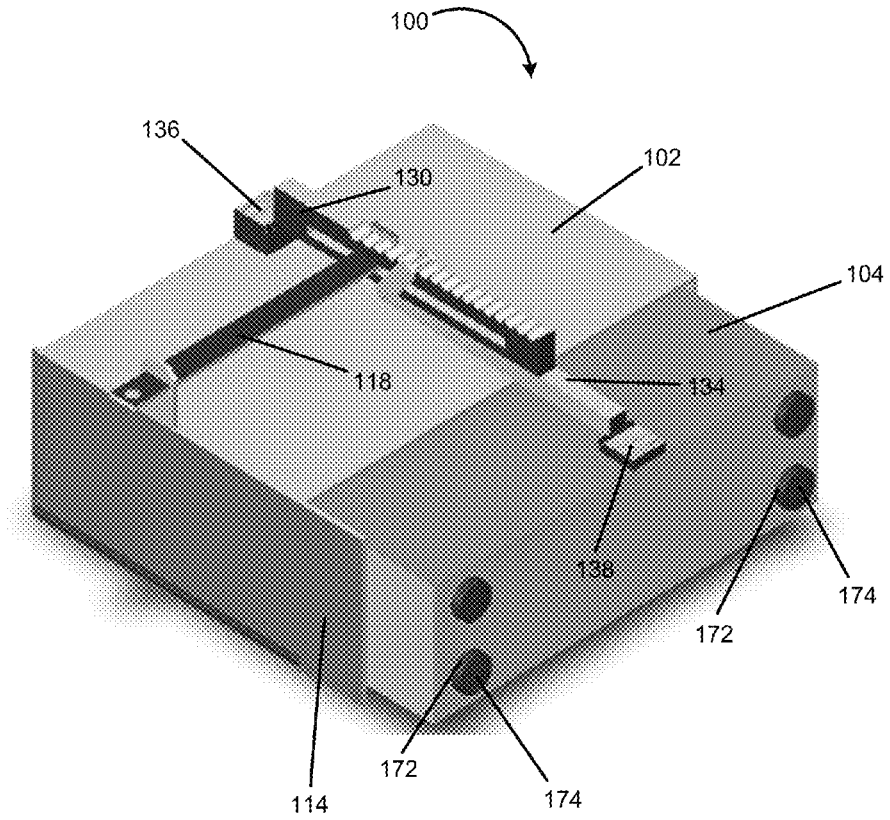
FIG. 17 is a perspective view of the expandable-collapsible safe according to another embodiment of the invention with the door in a closed position.
Figure 18:
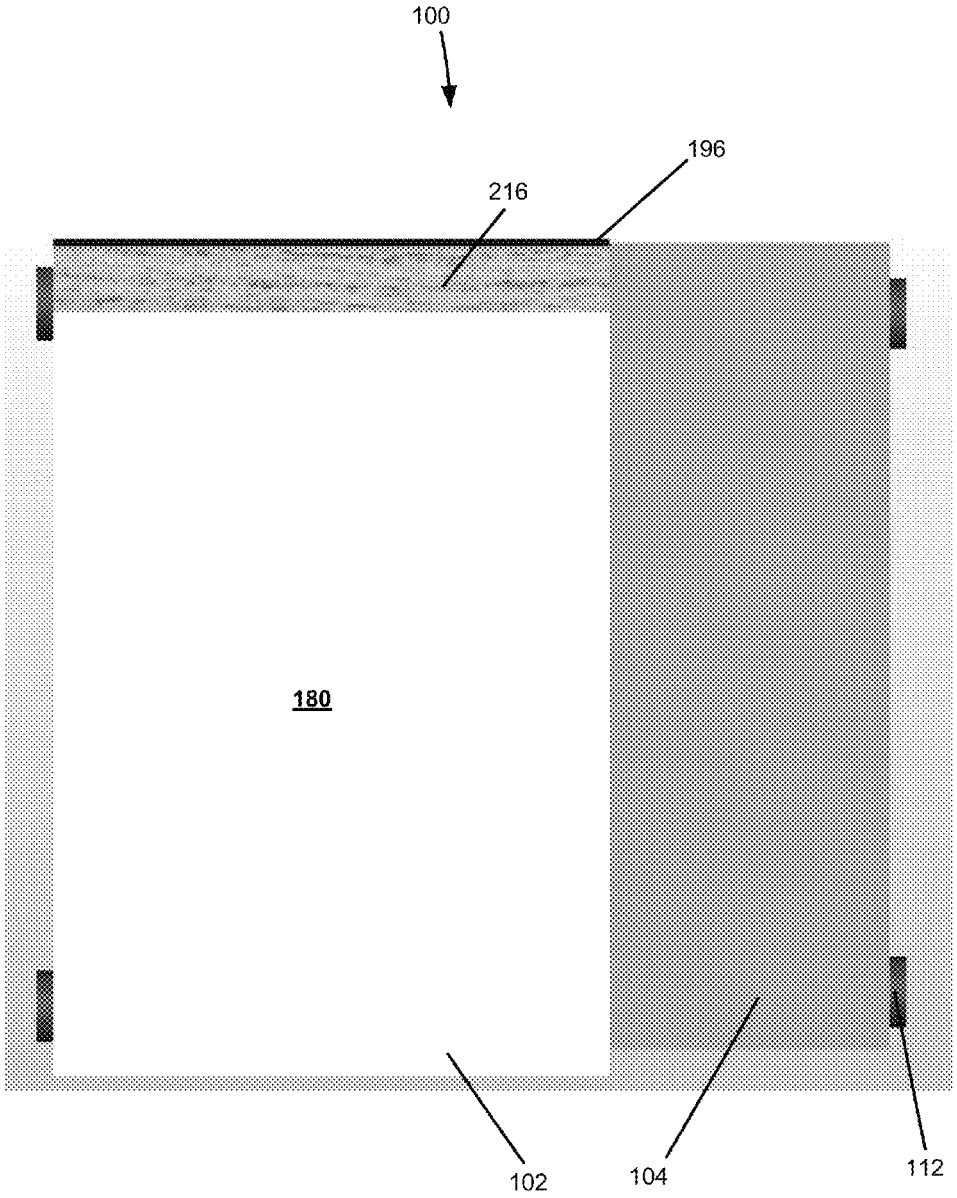
FIG. 18 is a bottom view of the expandable-collapsible safe of FIG. 17.

As shown in FIG. 13, first and second connectors 136, 138 form a hinge connection with the first and second tension bars 130, 134. The first and second tension bars 130, 134 are pivoted at the first and second hinge pins 140, 142, respectively. The first tension bar 130 has a plurality of recesses 132. The recesses 132 have a semi-circular cross-section as seen in FIG. 15. In other embodiments, the recesses 132 can also have a rectangular cross section. As best seen in FIGS. 14-16, the second tension bar 134 comprises an opening 156 at its second end 144. A first pin 146 engages with the opening 156 at the second end 144 of the second tension bar 134. Brackets 150 engage with the first pin 146 at the first end 152 of the brackets 150. The second end 154 of the brackets 150 engages with a second pin 148. The second pin 148 rests in a recess 132 when the safe 100 is not expanded or collapsed.

Figure 9:
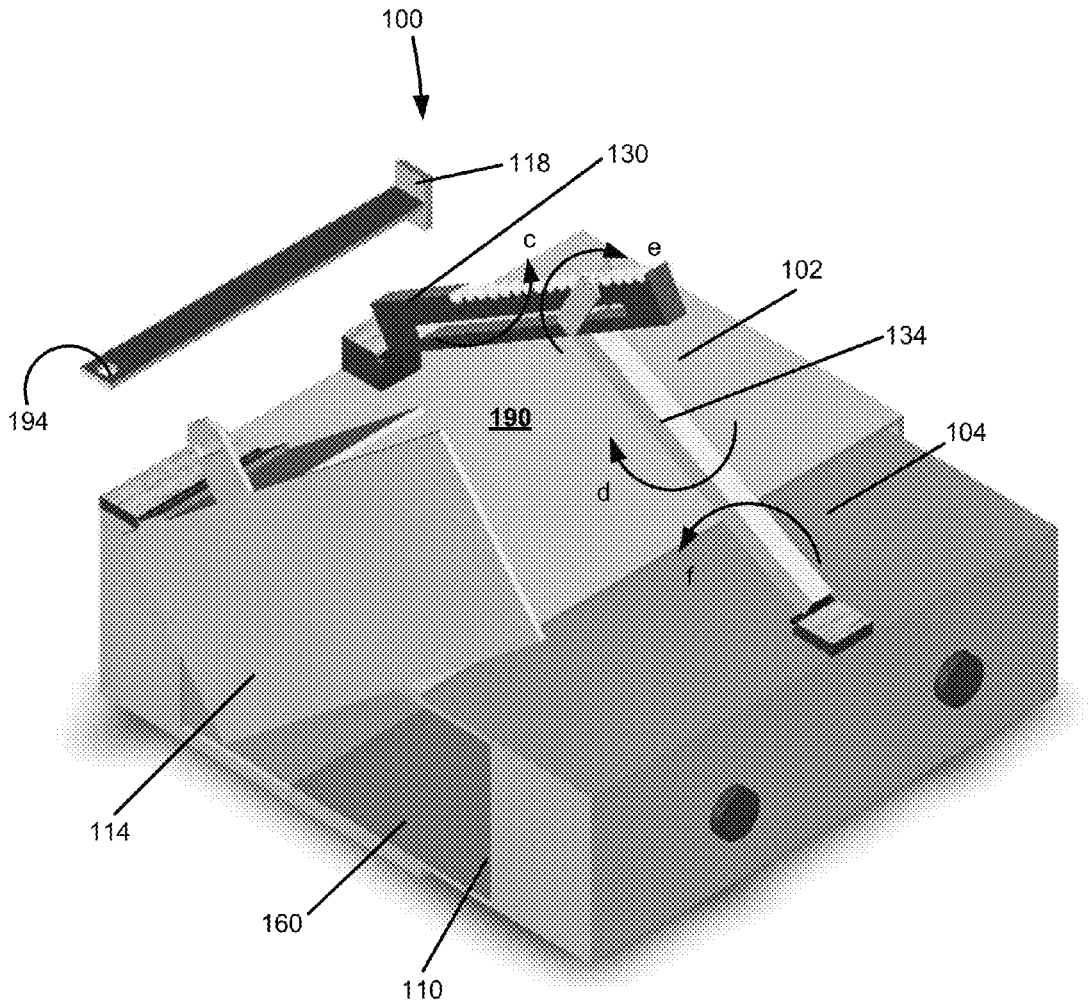
FIG. 9 is a perspective view of the expandable-collapsible safe shown in FIG. 1 when it is being expanded or collapsed with the door in an open position.

When the first and second enclosures 102, 104 are moved to collapse or expand the safe 100, the second pin 148 is released from a recess 132. The first tension bar 130 rotates about the first hinge pin 140 in a direction "c" as shown in FIG. 9. The second tension bar 134 rotates about the second hinge pin 142 in a direction "d". After the size of the safe 100 has been adjusted, the first tension bar 130 rotates about the first hinge pin 140 in a direction "e" as shown in FIG. 9. The second tension bar 134 rotates about the second hinge pin 142 in a direction "f". After the size of the safe 100 has been adjusted, the second pin 148 rests in another recess 132 and maintains the position of the first tension bar 130 with respect to the second tension bar 134, which prevents the second enclosure 104 from sliding within or out of the first enclosure 102.

Prior to expanding the safe 100, it can be positioned inside the locker. The safe can then be expanded by exerting the pushing force on the first and second enclosures 102, 104 in directions "x" and "y" respectively. In this position, the expandable-collapsible safe 100 is difficult to remove from the locker due to the friction fit between the locker walls and the bumpers 112.

In the illustrated embodiment, the first tension bar 130 includes a slot 158 of rectangular cross-section. Accordingly, the locking bar 118 is also of rectangular cross-section with a thickness that facilitates engaging the locking bar 118 with the slot 158 of the first tension bar 130. The slot 158 of the first tension bar 130 extends longitudinally along the first tension bar 130 to facilitate engaging the locking bar 118 at any desired longitudinal position of the first tension bar 130. The locking bar 118 includes a flared portion at the first end 120 of the locking bar 118 that is positioned flush against bracket 150. When the flared portion is positioned flush against the bracket 150, it prevents any further sliding of the first and second tension bars 130, 134, and consequently, the first and second enclosures 102, 104 within or away from each other. When a padlock or a combination lock is attached to the second end 122 of the locking bar 118, the flared portion on the first end 120 ensures that the door 114 remains locked.

In the illustrated embodiment, the expandable-collapsible safe 100 is unlocked by unlocking a padlock or a combination lock using a key or a numeric code first. The locking bar 118 is first removed from the hasp 124 by moving the flared portion of the locking bar 118 in a direction "g" away from the slot 158 of the first tension bar 130 as perhaps best shown in FIG. 12. The door 114 can then be rotated in a direction "z" or "x2", providing access to the contents stored in the expandable-collapsible safe 100, as shown in FIG. 6 or FIG. 19. The expandable-collapsible safe 100 is locked by rotating the door 114 in a direction "w" as shown in FIG. 6 or "y2" as shown in FIG. 19, and sliding the locking bar 118 into the slot 158 of the first tension bar 130 and the hasp 124 till the flared portion on the first end 120 of the locking bar 118 is flush against the bracket 150. A padlock or a combination lock can then be attached at the opening 160 on the second end 122 of the locking bar 118.

Figure 10:
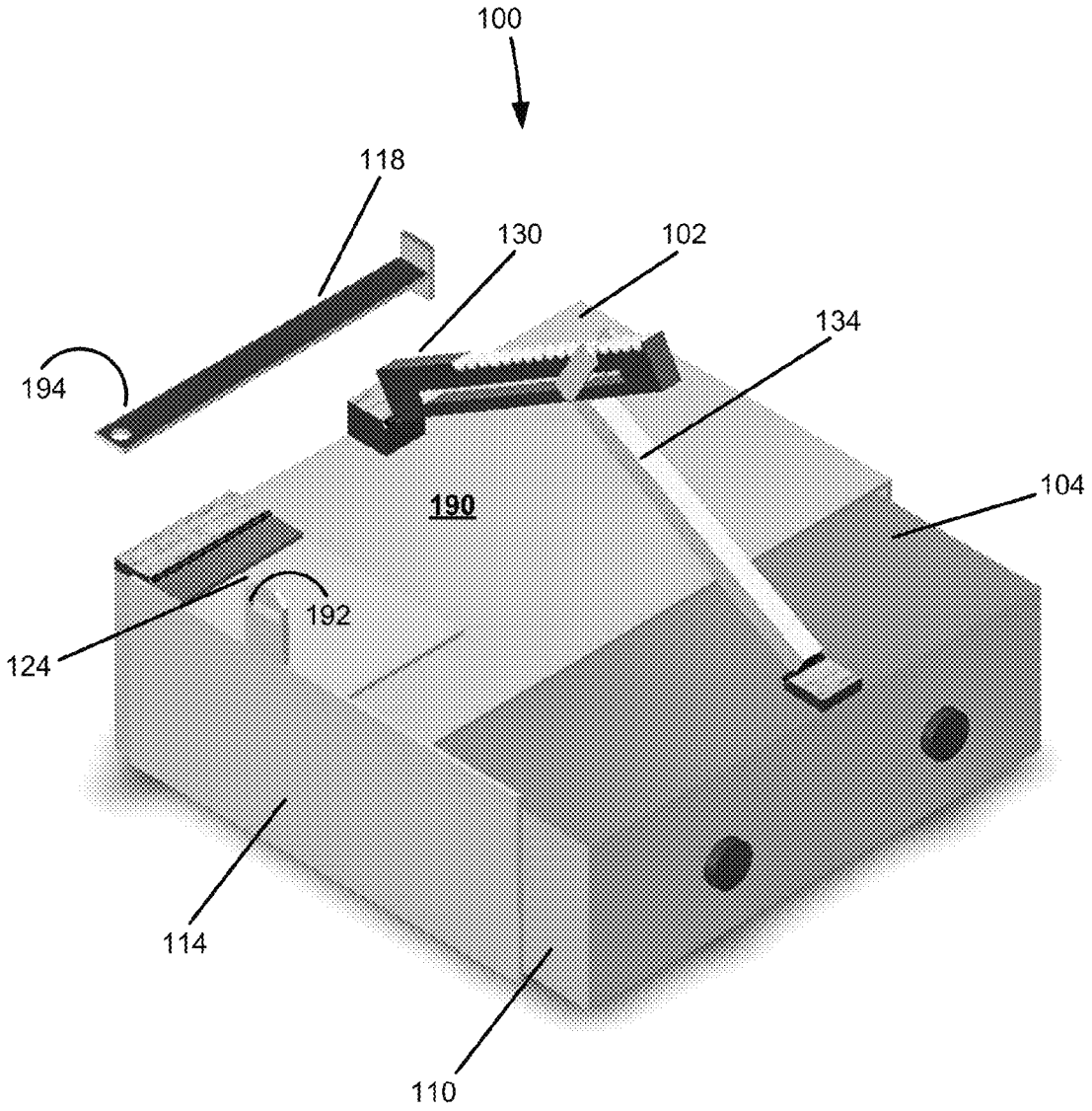
FIG. 10 is a perspective view of the expandable-collapsible safe shown in FIG. 1 when it is being expanded or collapsed with the door in a closed position.
Figure 11:
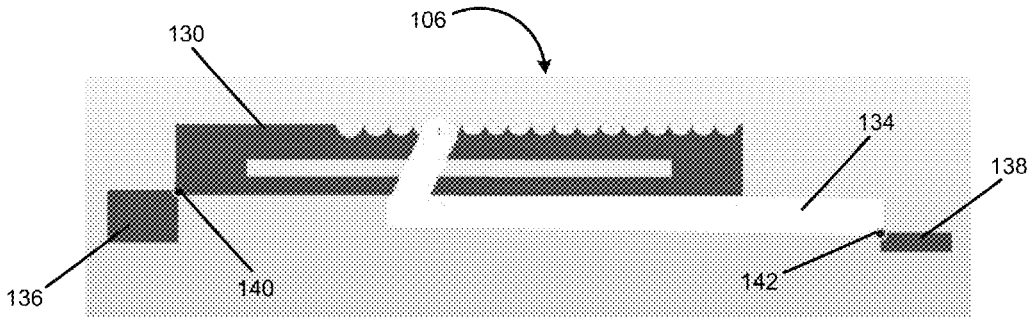
FIG. 11 is a view from the front of an adjustment mechanism of the expandable-collapsible safe shown in FIG. 1 according to some embodiments.

FIGS. 9 and 10 show the expandable-collapsible safe 100 when a user performs an expanding or a collapsing operation. In the illustrated embodiment, the expandable-collapsible safe 100 is collapsed or expanded by first unlocking the safe 100 as discussed previously. The locking bar 118 is disengaged from the hasp 124 and the slot 158 on the first tension bar 130 by sliding it in the direction "g" as shown in FIG. 12. The second pin 148 is removed from recess 132. To collapse the safe 100, the first and second enclosures 102, 104 are pushed towards each other. The first tension bar 130 rotates about the first hinge pin 140 in a direction "c" as shown in FIG. 9. The second tension bar 134 rotates about the second hinge pin 142 in a direction "d". After the size of the safe 100 has been adjusted, the first tension bar 130 rotates about the first hinge pin 140 in a direction "e". The second tension bar 134 rotates about the second hinge pin 142 in a direction "f". After the size of the safe 100 has been adjusted, the second pin 148 rests in another recess 132. The locking bar 118 is moved towards the slot 158 on the first tension bar 130 in a direction "h" as shown in FIG. 12. The locking bar 118 engages with the slot 192 on the first tension bar 130 and the hasp 124. The flared portion on the first end 120 of the locking bar 118 is positioned flush against the bracket 150. A lock can then be secured to the opening 160 on the second end 122 of the locking bar 118 to secure the contents of the safe.

In the foregoing detailed description, the invention has been described with reference to specific embodiments. However, it may be appreciated that various modifications and changes can be made without departing from the scope of the invention.

What is claimed is:

1. An expandable-collapsible safe, comprising:

a first enclosure;

a second enclosure modularly engaging with the first enclosure to create a storage space therein;

a door positioned on either the first enclosure or the second enclosure, the door being movable between an open position and a closed position;

an adjustment mechanism peripherally located on the first and second enclosures, the adjustment mechanism adapted to move the first and second enclosures between a collapsed position and an expanded position; and a locking mechanism adapted to lock the door in the closed position.

2. The expandable-collapsible safe of claim 1 wherein the adjustment mechanism comprises a first tension bar operably coupled to the first enclosure and a second tension bar operably coupled to the second enclosure, wherein the first tension bar engages with the second tension bar to expand and collapse the expandable-collapsible safe.

3. The expandable-collapsible safe of claim 2, wherein the first tension bar and the second tension bar are adapted to move the first enclosure and the second enclosure towards each other to collapse the expandable-collapsible safe when a pushing force is applied to the first tension bar and the second tension bar.

4. The expandable-collapsible safe of claim 2, wherein the first tension bar and the second tension bar are adapted to move the first enclosure and the second enclosure away from each other to expand the expandable-collapsible safe when a pulling force is applied to the first tension bar and the second tension bar.

5. The expandable-collapsible safe of claim 2, wherein one of the first tension bar and the second tension bars operably engages with the locking mechanism to lock the expandable-collapsible safe in a locked position.

6. The expandable-collapsible safe of claim 1, further comprising at least one bumper located on the peripheral portion of the expandable-collapsible safe, the bumper forming a frictional fit between the expandable-collapsible safe and an enclosure.

7. The expandable-collapsible safe of claim 1 wherein the locking mechanism comprises a locking bar and a hasp located on the door, the locking bar engaging with the hasp in the closed position and disengaging with the hasp in the open position.

8. The expandable-collapsible safe of claim 1 wherein the door is coupled to the first enclosure or the second enclosure by a door connector, the door connector including a hinge connection such that the door rotates about the hinge connection.

9. An expandable-collapsible safe, comprising:

a first enclosure;

a second enclosure modularly engaging with the first enclosure to create a storage space therein;

a door positioned on the first enclosure or the second enclosure, the door being movable between an open position and a closed position, the door configured to cover an opening on the first and second enclosures;

an adjustment mechanism peripherally located on the first enclosure and the second enclosure, the adjustment mechanism adapted to move the first enclosure and the second enclosure between a collapsed position and an expanded position; and a locking mechanism operably engaging with the adjustment mechanism, the locking mechanism adapted to the lock the door in the closed position.

10. The expandable-collapsible safe of claim 9 wherein the adjustment mechanism comprises a tension bar with a slot, and the locking mechanism comprises a locking bar, the locking bar engaging with the slot in a sliding engagement.

11. The expandable-collapsible safe of claim 10 wherein the locking bar includes a first end, the first end comprising a flared portion, the flared portion having a width larger than the slot.

12. The expandable-collapsible safe of claim 10 wherein the locking mechanism includes a hasp positioned on the door, the locking bar engaging with the tension bar and the hasp to maintain the door in the closed position and the locking bar disengaging with the tension bar and the hasp to move the door from the closed position to the open position.

13. An expandable-collapsible safe, comprising:

a first enclosure;

a second enclosure modularly engaging with the first enclosure to create a storage space therein;

a door positioned on either the first enclosure or the second enclosure, the door being movable between an open position and a closed position;

an adjustment mechanism peripherally located on the first and second enclosures, the adjustment mechanism adapted to move the first and second enclosures between a collapsed position and an expanded position by sliding movement of the first enclosure and the second enclosure;

a locking mechanism operably engaging with the adjustment mechanism the locking mechanism adapted to the lock the door in the closed position wherein a pushing force is applied to the first and second enclosures to collapse the expandable-collapsible safe and a pulling force is applied to the first and second enclosures to expand the expandable-collapsible safe.

14. The expandable-collapsible safe of claim 13 wherein the adjustment mechanism includes a first tension bar and a second tension bar, the first tension bar comprising a plurality of recesses and the second tension bar including a pin, the recesses being configured to receive the pin.

15. The expandable-collapsible safe of claim 14, wherein the pin is removed from a first recess of the plurality of the recesses when the expandable-collapsible safe is expanded or collapsed and the pin is placed in a second recess of the plurality of the recesses after the expandable-collapsible safe is expanded or collapsed.

16. The expandable-collapsible safe of claim 15, wherein the second tension bar is pivotably connected to a bracket, the bracket operably coupled to the pin of the second tension bar such that when a pushing force or a pulling force is applied on the first and second enclosures, the bracket is adapted to move the pin from the first recess of the plurality of recesses to the second recess of the plurality of recesses.

17. The expandable-collapsible safe of claim 14 wherein the first tension bar is coupled to the first enclosure by a first hinge connector, and the second tension bar is coupled to the second enclosure by a second hinge connector.

18. The expandable-collapsible safe of claim 17 wherein the first tension bar rotates in a first direction about the first hinge connector and the second tension bar rotates in a second direction about the second hinge connector, when the expandable-collapsible safe is adapted to move between the expanded position and the collapsed position by applying the pushing force to collapse or the pulling force to expand the expandable-collapsible safe.

19. The expandable-collapsible safe of claim 17 wherein the first tension bar rotates in a third direction about the first hinge connector and the second tension bar rotates in a fourth direction about the second hinge connector, after the pushing force or the pulling force is removed.

20. The expandable-collapsible safe of claim 17 wherein the door rotates about a rotational axis between the open position and the closed position, the rotational axis of the door being perpendicular to the first and second hinge connectors.

* * * * *